US011658017B2

(12) United States Patent
Kovtoun

(10) Patent No.: US 11,658,017 B2
(45) Date of Patent: May 23, 2023

(54) METHODS AND DEVICES FOR HIGH-THROUGHPUT DATA INDEPENDENT ANALYSIS

(71) Applicant: Thermo Finnigan LLC, San Jose, CA (US)

(72) Inventor: Viatcheslav V. Kovtoun, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 209 days.

(21) Appl. No.: 17/091,795

(22) Filed: Nov. 6, 2020

(65) Prior Publication Data

US 2021/0057199 A1 Feb. 25, 2021

Related U.S. Application Data

(62) Division of application No. 16/165,909, filed on Oct. 19, 2018, now Pat. No. 10,832,897.

(51) Int. Cl.

| | |
|---|---|
| ***H01J 49/00*** | (2006.01) |
| ***H01J 49/40*** | (2006.01) |
| ***H01J 49/42*** | (2006.01) |
| *H01J 49/06* | (2006.01) |

(52) U.S. Cl.

CPC ..... *H01J 49/0031* (2013.01); *H01J 49/40* (2013.01); *H01J 49/4225* (2013.01); *H01J 49/062* (2013.01)

(58) Field of Classification Search

CPC .... H01J 49/0031; H01J 49/40; H01J 49/4225; H01J 49/062

See application file for complete search history.

(56) References Cited

U.S. PATENT DOCUMENTS

| | | | |
|---|---|---|---|
| 6,812,453 | B2 | 11/2004 | Bateman et al. |
| 7,157,698 | B2 | 1/2007 | Makarov et al. |
| 7,405,401 | B2 | 7/2008 | Hoyes |
| 7,718,959 | B2 | 5/2010 | Franzen et al. |
| 8,581,177 | B2 | 11/2013 | Kovtoun |

(Continued)

FOREIGN PATENT DOCUMENTS

| | | | |
|---|---|---|---|
| CA | 2407957 | A1 | 11/2003 |
| CN | 1689134 | A | 10/2005 |

(Continued)

OTHER PUBLICATIONS

Plass et al., "Multiple-reflection time-of-flight mass spectrometry", International Journal of Mass Spectrometry 349-350 (2013), pp. 134-144.

*Primary Examiner* — Wyatt A Stoffa

(57) ABSTRACT

A method of analyzing a sample, the method includes separating precursor ions from the sample into narrow mass range groups based on mass-to-charge ratio; fragmenting the ions from each group to create groups of fragment ions; and mass analyzing fragment ions from each group of fragment ions using a long transient time mass analyzer, wherein the separation and fragmentation are decoupled from the mass analyzing and the cycle time of the high transient mass analyzer is greater than about five times longer than the cycle time of a narrow mass range scan time, and wherein the separation and fragmentation has a high duty cycle and the mass analyzing has a high duty cycle.

9 Claims, 8 Drawing Sheets

(56) References Cited

U.S. PATENT DOCUMENTS

| | | | | |
|---|---|---|---|---|
| 8,629,409 | B2 | 1/2014 | Kovtoun | |
| 9,330,894 | B1 | 5/2016 | Kovtoun | |
| 9,831,076 | B2 * | 11/2017 | Kovtoun | H01J 49/4295 |
| 2004/0065824 | A1 | 4/2004 | Bateman et al. | |
| 2007/0029473 | A1 | 2/2007 | Verentchikov | |
| 2009/0173877 | A1 * | 7/2009 | Bateman | H01J 49/42 250/281 |
| 2012/0256083 | A1 | 10/2012 | Kovtoun | |
| 2013/0105681 | A1 * | 5/2013 | Kovtoun | H01J 49/009 250/288 |
| 2013/0228678 | A1 * | 9/2013 | Savitski | G16C 20/20 250/282 |
| 2015/0021472 | A1 | 1/2015 | Makarov | |
| 2015/0287585 | A1 | 10/2015 | Kovtoun et al. | |
| 2016/0020076 | A1 | 1/2016 | Makarov | |
| 2020/0286721 | A1 * | 9/2020 | Meissner | H01J 49/004 |
| 2021/0375611 | A1 * | 12/2021 | Remes | H01J 49/401 |

FOREIGN PATENT DOCUMENTS

| | | | |
|---|---|---|---|
| WO | 2013093114 | A2 | 6/2013 |
| WO | 2013171459 | A2 | 11/2013 |

* cited by examiner

METHODS AND DEVICES FOR HIGH-THROUGHPUT DATA INDEPENDENT ANALYSIS

CROSS-REFERENCE TO RELATED APPLICATION

This application is a divisional under 35 U.S.C. § 121 and claims the priority benefit of co-pending U.S. patent application Ser. No. 16/165,909, filed Oct. 19, 2018. The disclosure of the foregoing application is incorporated herein by reference.

FIELD

The present disclosure generally relates to the field of mass spectrometry including methods and devices for high-throughput data independent analysis.

INTRODUCTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list. There is growing interest in the use of "all-mass" MS/MS, in which all or a substantial subset of the precursor ions are fragmented. All-mass MS/MS yields information-rich spectra and removes the need to select and isolate particular ion species prior to mass analysis. In order to simplify the interpretation of product ion spectra produced by all-mass MS/MS, the analysis is conducted as a series of fragmentation/spectral acquisition cycles performed on different subsets or groups of the precursor ions, with each subset or group representing a different range of precursor ion m/z's. For example, if the precursor ions have m/z's ranging from 200 to 2000 Th, the first fragmentation/spectral acquisition cycle may be performed on a first group of ions having m/z's between 200 and 210 Th, the second fragmentation/acquisition cycle may be performed on a second group of ions having m/z's between 210 and 220 Th, and so on. U.S. Pat. No. 7,157,698 to Makarov et al., the disclosure of which is incorporated by reference, teaches a mass spectrometer architecture for implementing all-mass MS/MS with separation of the precursor ions into groups according to their m/z's. In the Makarov apparatus, an orthogonal-ejection two-dimensional ion trap is employed to eject m/z-grouped precursor ions into a fragmentation cell, where the ions undergo fragmentation. The resultant product ions are transported to the entrance of a time-of-flight (TOF) mass analyzer for acquisition of a mass spectrum. TOF mass analyzers are particularly well-suited to all-mass MS/MS experiments due to their wide mass ranges and relatively short analysis times.

In TOF and other mass analyzers, large variations in the initial kinetic energies of the ions may significantly compromise measurement performance, particularly with respect to resolution and mass accuracy. As such, it is important to reduce the kinetic energy spread of the ejected ions, and product ions derived therefrom, prior to delivering the ions to the entrance of the mass analyzer. Cooling of the ions to reduce kinetic energy and kinetic energy spread may be accomplished by directing the ions through a cooling region in which the ions lose energy via collisions with neutral gas molecules. The cooling time may be substantially greater than the times required for ejection of an ion group from the trap (as well as for mass analysis of an ion group), which means that the ejection of a subsequent ion group from the trap into the fragmentation/cooling region must be delayed until cooling of the first ion group is completed. Differently expressed, the cooling period limits the rate at which the all-ion MS/MS analysis may be conducted and reduces the total number of analyses that may be performed during a chromatographic elution peak. Of course, the rate may be increased by employing a shorter cooling period, but doing so has a deleterious effect on resolution and/or mass accuracy.

Decoupling the fragmentation cell, the cooling, and the mass analysis from one another while keeping the product ions of one fragmentation cycle together, but separate from product ions from other fragmentation cycles, can improve the throughput of the analysis. From the foregoing it will be appreciated that a need exists for improved systems and methods for improved high-throughput data independent analysis, such as for all atom MS/MS.

SUMMARY

In a first aspect, a method of analyzing a sample, the method can include separating precursor ions from the sample into narrow mass range groups based on mass-to-charge ratio; fragmenting the ions from each group to create groups of fragment ions; mass analyzing fragment ions from each group of fragment ions using a long transient time mass analyzer. The separation and fragmentation can be decoupled from the mass analyzing and the cycle time of the high transient mass analyzer is greater than about five times longer than the cycle time of a narrow mass range scan time. The separation and fragmentation can have a high duty cycle and the mass analyzing can have a high duty cycle.

In various embodiments of the first aspect, the cycle time of the mass analyzer can be greater than about ten times longer than the cycle time of the narrow mass range scan time, such as less than about 15 times longer than the cycle time of the narrow mass range scan time.

In various embodiments of the first aspect, the cycle time of the narrow mass range scan time can be between about 50 microseconds and about 500 microseconds, such as between about 100 microseconds and about 400 microseconds, even between about 200 microseconds and about 300 microseconds.

In various embodiments of the first aspect, the cycle time of the mass analyzer is between about 1 millisecond and about 10 milliseconds, such as between about 3 milliseconds and about 7 milliseconds, even between about 4 and 6 milliseconds.

In a second aspect, a mass spectrometer can include an ion source configured to produce precursor ions from a sample; a linear ion trap configured to separate the precursor ions into a plurality of narrow mass ranges based on mass-to-charge ratio; and a fragmentation device configured to fragment ions in a narrow mass range to generate a group of fragment ions. The mass spectrometer can further include a first storage cell array and a second storage cell array. The first storage cell array can include a first storage cell and a second storage cell. The first storage cell can be configured to accumulate fragment ions from the fragmentation device from the first narrow mass range and the second storage cell can be configured to accumulate fragment ions from the fragmentation device from a second narrow mass range. The a first storage cell array can be configured to isolate fragment ions from the first narrow mass range from fragment ions from the second narrow mass range. The second storage cell array can include a third storage cell and a fourth storage cell. The third storage cell can be configured to receive ions from the first storage cell and the fourth storage cell can be configured to receive ions from the second storage cell. The mass spectrometer can also include a mass analyzer configured to receive ions from the third storage cell and analyze the mass-to-charge ratio of fragment ions from the first narrow mass range and separately receive ions from the fourth storage cell and analyze the mass-to-charge ratio of fragment ions from the second narrow mass range.

In various embodiments of the second aspect, the mass analyzer is a long transient time mass analyzer. In particular embodiments, the long transient time mass analyzer is a multi-reflection time-of-flight mass analyzer.

In various embodiments of the second aspect, mass spectrometer can further include an ion transport system configured to transport fragment ions from the fragmentation device to the first storage cell array while isolating fragment ions from the first narrow mass range from fragment ions from the second narrow mass range. The transport system can include a plurality of pole rods arranged in first and second rows, the second row parallel to the first row, each pole rod of the first row forming a pole rod pair with a corresponding pole rod of the second row. The pole rod pairs can define a plurality of ion transport cells, each ion transport cell uniquely corresponding to a contiguous group of a fixed number of pole rod pairs, such that no two ion transport cells share a common pole rod pair.

In particular embodiments, the mass spectrometer can further include a second ion transport system configured to transport fragment ions from the second storage cell array to the mass analyzer while isolating fragment ions from a first narrow mass range from fragment ions from a second narrow mass range. The transport system can include a second plurality of pole rods arranged in third and fourth rows, the fourth row parallel to the third row. Each pole rod of the third row can form a pole rod pair with a corresponding pole rod of the fourth row. The pole rod pairs can define a plurality of ion transport cells, each ion transport cell uniquely corresponding to a contiguous group of a fixed number of pole rod pairs, such that no two ion transport cells share a common pole rod pair.

In particular embodiments, the first ion transport system can be configured to eject ions in a direction parallel to the pole rods into the storage cell array and the second ion transport system can be configured to eject ions in a direction of travel along the second plurality of pole and into the mass analyzer.

In various embodiments of the second aspect, the narrow mass range has a range of less than about 20 Da, such as a range of less than about 10 Da, even a range of less than about 5 Da.

In various embodiments of the second aspect, the mass spectrometer can further include a first ion path including the first storage cell array and the second storage cell array and a second ion path including a third storage cell array and a fourth storage cell array, wherein the fragmentation device directs fragment ions from a third narrow mass range and fragment ions from a fourth narrow mass range to the second ion path. In particular embodiments, the first ion path can further include a first ion transport system configured to transport fragment ions from the fragmentation device to the first storage cell array while isolating fragment ions from the first narrow mass range from fragment ions from the second narrow mass range and the second ion path can further include a second ion transport system configured to transport fragment ions from the fragmentation device to the third storage cell array while isolating fragment ions from the third narrow mass range from fragment ions from the fourth narrow mass range. In particular embodiments, the mass spectrometer can further include a third ion transport system configured to transport fragment ions from the second storage cell array and the fourth storage cell array to the mass analyzer.

In a third aspect, a method of analyzing a sample can include separating precursor ions from the sample into a plurality of narrow mass ranges based on the mass-to-charge ratio; fragmenting the precursor ions of each narrow mass range to generate a plurality of fragment ions groups; accumulating fragment ions from a first narrow mass range in a first storage cell of a first storage cell array and ions from a second narrow mass range in a second storage cell of the first storage cell array while isolating fragment ions from the first narrow mass range from fragment ions from the second narrow mass range; transferring ions from first storage cell of the first storage cell array to a third storage cell of a second storage cell array and from the second storage cell of the first storage cell array to a fourth storage cell of the second storage cell array; and separately analyzing the mass-to-charge ratio, using a long transient time mass analyzer, of the fragment ions from the third storage cell and from the fourth storage cell while fragment ions from a third narrow mass range are accumulated in the first storage cell and fragment ions from a fourth narrow mass range are accumulated in the second storage cell.

In various embodiments of the third aspect, separating precursor ions can include ejecting ions of each narrow mass range in discrete groups from an ion trap.

In various embodiments of the third aspect, the method can further include transporting the fragment ion groups using a ion transport system while maintaining separation between the fragment ion groups; wherein the ion transport system can include a plurality of pole rod arranged in first and second rows, the second row parallel to the first row, each pole rod of the first row forming a pole rod pair with a corresponding pole rod of the second row, the pole rod pairs defining a plurality of ion transport cells, each ion transport cell uniquely corresponding to a contiguous group of a fixed number of pole rod pairs, such that no two ion transport cells share a common pole rod pair.

In particular embodiments, transporting the fragment ions can include applying an initial voltage pattern to the pole rods of the first row and a common voltage to the pole rods of the second row of the ion transport cells to create a plurality of potential wells within the ion transport cells, wherein each ion transport cell receives the same pattern of voltages; injecting a first plurality of ions into the first ion transport cell traveling in a direction parallel to the primary axes of the pole rods and capturing the first plurality of ions in the potential well of the first ion transport cell; altering the voltage pattern applied to the pole rods of the ion transport cells to move the potential well and the first plurality of ions to the second ion transport cell; and injecting a second plurality of ions into the first ion transport cell traveling in a direction parallel to the primary axes of the pole rods and capturing the second plurality of ions in the potential well of the first ion transport cell when a first cycle of the altering the voltage pattern is complete.

In particular embodiments, the ion transport system can include a first plurality of pole rods configured to transport ions to the storage cell array and a second plurality of pole rods configured to transport ions to the mass analyzer, and further comprising ejecting ions from the first plurality of pole rods into the storage cell array in a direction parallel to the pole rods of the first plurality of pole rods and ejecting ions from the second plurality of pole rods into the mass analyzer in a direction of travel along the second plurality of pole. In particular embodiments, ejecting ions from the first plurality of pole rods can include ejecting the ions in parallel from two or more ion transport cells and ejecting ions from the second plurality of pole rods can include ejecting the ions in a consecutive fashion.

In various embodiments of the third aspect, fragmenting the precursor ions includes directing precursor ions from a first narrow mass range into a fragmentation device.

In various embodiments of the third aspect, the narrow mass range has a range of less than about 20 Da, such as a range of less than about 10 Da, even a range of less than about 5 Da.

DRAWINGS

For a more complete understanding of the principles disclosed herein, and the advantages thereof, reference is now made to the following descriptions taken in conjunction with the accompanying drawings, in which.

Figure 1:
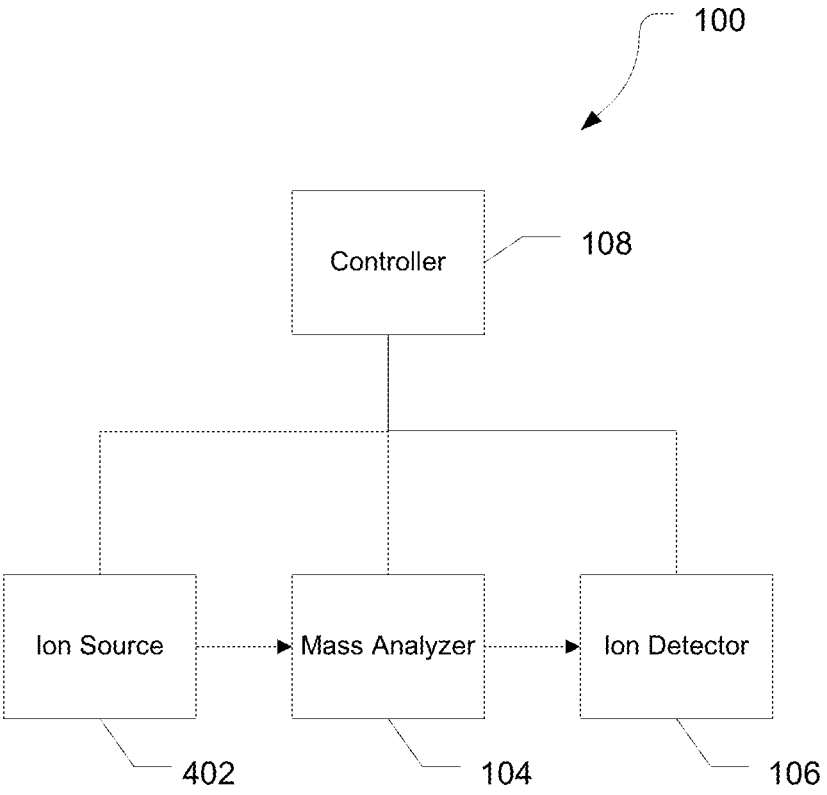
FIG. 1 is a block diagram illustrating an exemplary mass spectrometry system.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for transporting ions are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, inductively coupled plasma (ICP) source, electron ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a time-of-flight (TOF) analyzer, a quadrupole ion trap analyzer, an electrostatic trap (e.g., Orbitrap) mass analyzer, and the like. In various embodiments, the mass analyzer 104 can also be configured to fragment the ions and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configured the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Figure 2:
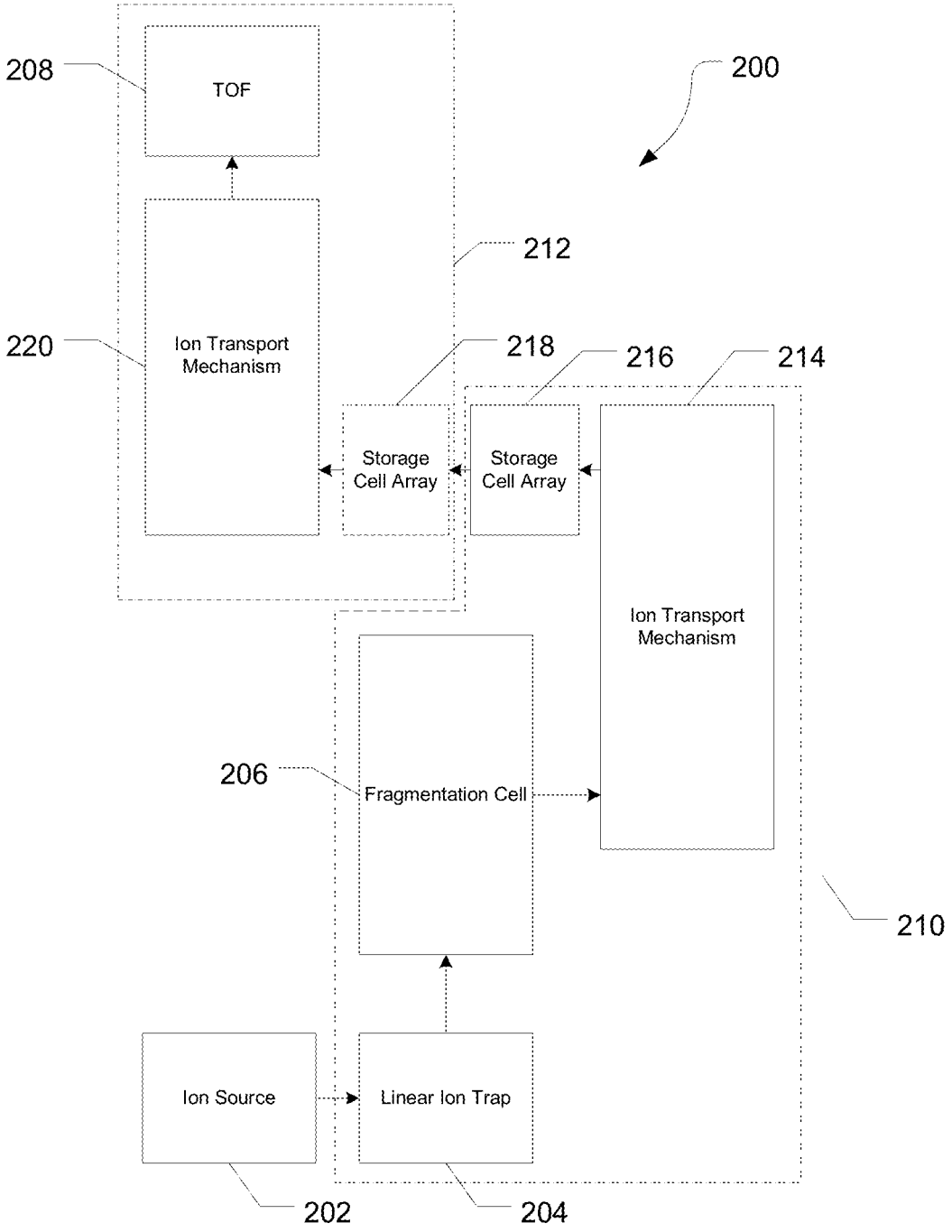
FIG. 2 is a block diagram illustrating another exemplary mass spectrometry system, in accordance with various embodiments.

Various embodiments of mass spectrometry system 200 can include components as displayed in the block diagram of FIG. 2. Mass spectrometry system 200 can include an ion source 202, a linear ion trap 204, a fragmentation cell 206, and a long transient mass analyzer 208. In various embodiments, the long transient mass analyzer 208 can be a multireflection TOF mass analyzer or a Fourier transform mass analyzer like an ORBITRAP mass analyzer.

Ions from the ion source 202 can be accumulated in the linear ion trap 204. In particular embodiments, the linear ion trap 204 can separate the ions into a plurality of narrow mass ranges. In various embodiments, the narrow mass ranges can have a width of less than about 20 Da, such as less than about 10 Da, even less than about 5 Da. The ions from each narrow mass range can be sent to the fragmentation cell 206 where they can be fragmented into fragment ions. The fragment ions from each narrow mass range can then be mass analyzed in the mass analyzer. Mass analyzing the ion fragments for each narrow mass range separately from the fragment ions of other narrow mass ranges can simplify the assignment of fragment ions to the precursor ions.

In various embodiments, the linear ion trap 204 can eject ions radially. Radial ejection can increase the analytical capacity of the linear ion trap as compared to axial ejection. Additionally, with radial ejection, a portion of the ions can be ejected out the opposite side of the linear ion trap 204. In various embodiments, the ion intensity of a narrow mass range can be determined by measuring the intensity of the ions ejected from the opposite side of the linear ion trap 204. In some embodiments, information about the ion intensity of the narrow mass range can be used for automatic gain control.

In various embodiments, there can be a significant difference between the cycle time of the linear ion trap 204 and the long transient mass analyzer 208. For example, the time to scan ions within a narrow mass range out of the linear ion trap 204 and into the fragmentation cell 206 can be on the order of a few hundred microseconds, such as between about 50 microseconds and about 500 microseconds, such as between about 100 microseconds and about 400 microseconds, even between about 200 microseconds and about 300 microseconds. The time required for the long transient mass analyzer can be significantly greater, such as at least about 5 times greater, such as at least about 10 times greater, even at least about 15 times greater. For example, the cycle time of the long transient mass analyzer can be on the order of a few milliseconds, such as between about 1 millisecond and about 10 milliseconds, such as between about 3 milliseconds and about 7 milliseconds, even between about 4 and 6 milliseconds.

In various embodiments, due to the significant cycle time difference between the linear ion trap 204 and the long transient mass analyzer 208, the system can be considered to have two timing regions 210 and 212. Timing region 210 can include the linear ion trap 204 and the fragmentation cell 206, and timing region 212 can include the long transient mass analyzer 208. Additionally, timing region 210 can include a moving latch ion transport mechanism 214 and a storage cell array 216 and timing region 212 can include an optional storage cell array 218 and a moving latch ion transport mechanism 220.

Moving latch ion transport mechanisms 214 can transport ion packets (ion fragments for a narrow mass range) from the fragmentation cell 206 to the storage cell array 216 while maintaining the separation between narrow mass ranges. The storage cell array 216 can store fragment ions from one narrow mass range separately from fragment ions from another mass range. The fragment ions can be transferred from storage cell array 216 to storage cell array 218 and then the ion stored by storage cell array 218 can be transferred to the ion transport mechanism 220 to be transported to the mass analyzer 208. Here again, ion transport mechanism 220 can maintain separation between ion packets to ensure fragment ions from one narrow mass range can be analyzed by the mass analyzer 208 separately from fragment ions from other narrow mass ranges.

Timing regions 210 and 212 are decoupled at the point between storage cell array 216 and optional storage cell array 218. Ions can be fed into storage cell array 216 according to the timing requirements of timing region 210 while ions can be transferred out of storage cell array 218 according to the timing requirements of timing region 212. It may only be necessary for the timing cycles of timing region 210 and timing region 212 to align when the ions are transferred from storage cell array 216 to storage cell array 218. At that point, storage cell array 218 can be empty so that ions from storage cell array 216 do not mix with ions from previous cycles. In various alternative embodiments, storage cell array 216 can feed ions directly to moving latch transport mechanism 220 without the need for storage cell array 218.

Figure 3:
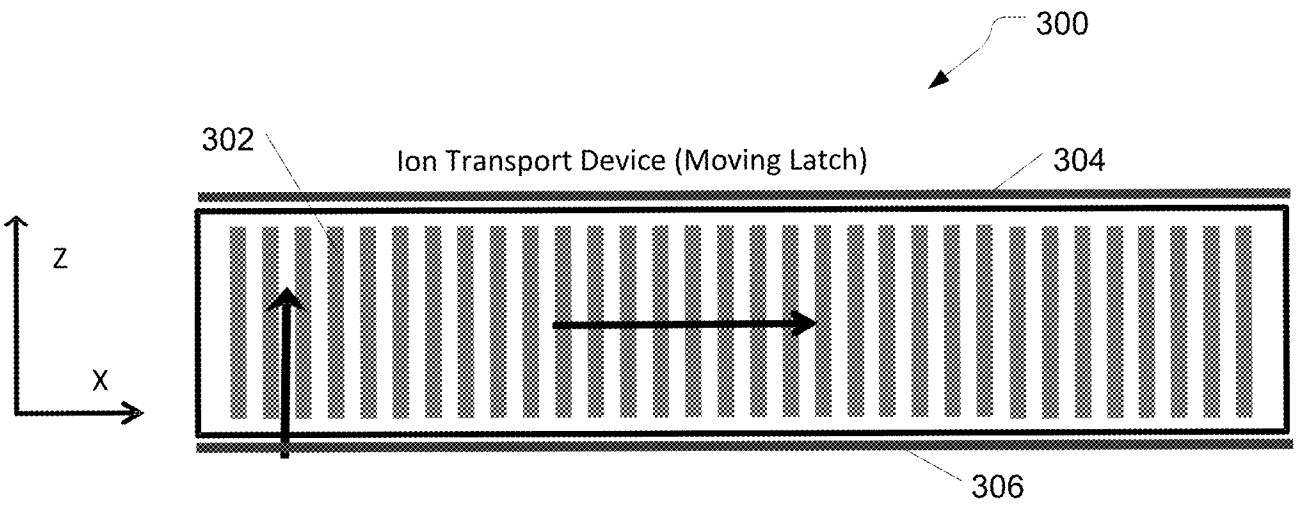
FIG. 3 is a block diagram illustrating an exemplary ion transport mechanism, in accordance with various embodiments.

FIG. 3 is a block diagram illustrating ion transport mechanism 300.

The ion transport mechanism 300 can include a plurality of pole rod pairs 302 arranged parallel to one another along a length (x-axis) of the ion transport mechanism 300. In various embodiments, each pole rod pair 302 can consist of 2 pole rods separated in the direction orthogonal to the plane of the FIG. 1. Additionally, the moving latch may include guard electrodes 304 and 306.

In various embodiments, the ion transport mechanism 300 can be considered to contain a plurality of ion transport cells, defined by a contiguous group of a fixed number of pole rod pairs. The ion transport cells can be arranged such that no two ion transport cells share a common pole rod pair. For example, an ion transport cell can consist of 3 pole rod pairs, 4 pole rod pairs, or even 5 or more pole rod pairs. A pattern of DC or AC voltages can be applied to the pole rod pairs of a cell, and the same pattern can be applied to each cell of the moving latch ion transport device. In various embodiments, the pattern can include a spatial sequence or progression of voltages applied to contiguous pole rod pairs that recurs along the length of the ion transport device, such that each ion transport cell receives the same pattern of voltages. The pattern can move along the moving latch ion transport device, such as by stepping the start of pattern along the plurality of pole rod pairs. For example, at to the first voltage of the pattern may be applied to a rod pair $r_0$ and the rest of the pattern may be applied to the contiguous rods $r_1$ through $r_{n-1}$, and the pattern can start over again at $r_n$. At $t_1$, the first voltage of the pattern may be applied to $r_1$ and the rest of the pattern may be applied to contiguous rods $r_2$ through $r_n$, with the pattern starting over again at $r_{n+1}$, while the nth voltage can be applied to $r_0$. At $t_{n-1}$, the voltage pattern may start at $r_{n-1}$, whereas at $t_n$, the voltage pattern may start at $r_0$ again, with the first repeat of the starting at $r_n$. In particular embodiments, a potential well can be created by the pattern of voltages and ions trapped in the well can be passed from cell to cell along the length of the moving latch ion transport device as the changing pattern of voltages shifts the potential well along a cell and to the next cell.

In various embodiments, ions can be transferred into the ion transport mechanism 300 by injecting the fragment ions into the ion transport mechanism 300 and parallel to the primary (longitudinal) axes of the pole rod pairs (in the z direction). The ions can then be sequentially transferred within and between the ion transport cells along the length of the ion transport mechanism 300 (x direction, perpendicular to the primary axes of the pole rods) through manipulation of the electrical potentials of the pole rods. In various embodiments, the ions can be trapped within a potential well formed by the rods. As the potential well is moved along the ion transport mechanism 300, fragment ions of various m/z ratios and ion mobilities can be kept together, rather than being dispersed along the length of the ion transport mechanism 300 as would be the case if a potential wave was used to drive the ions.

In various embodiments, the ion transport mechanism 300 can be filled with a damping or cooling gas. The damping gas can include He, $N_2$, Ar, air, or the like. In various embodiments, the gas can be at a pressure in a range of about 0.1 mtorr to about 100 mtorr, such as in a range of about 1 mtorr to about 30 mtorr.

A high potential can be placed on the guard electrodes 304 and 306 to confine the ions in the z dimension, until such time as the ions need to be removed from the ion transport mechanism 300. In various embodiments, ions may be ejected from the ion transport mechanism 300 by placing a high potential on guard electrode 306 and a low potential on guard electrode 304 and driving the ions out of the ion transport mechanism 300 in the z direction (parallel to the length of the pole rods). The ions may be also ejected from the ion transport mechanism 300 in the z direction by using segmented rods with a gradient potential applied to drive the ions out of the ion transport mechanism 300. In various embodiments, several packets of ions can be transferred from the ion transport mechanism 300 at substantially the same time, such as when transferring ion packets into a storage cell array with storage cells aligned with each of the cells of the ion transport mechanism 300.

Alternatively, ions may be ejected in the x direction from the ion transport mechanism 300 into another device, such as a mass analyzer, by advancing the voltage pattern until the trailing high potential forces the ions from the end of the ion transport mechanism 300. In yet another embodiment, an electrode (not shown) can be placed adjacent to the ion transport device in the y direction. A high voltage applied to the electrode can eject the ions from the ion transport device in the y direction away from the electrode.

Figure 4:
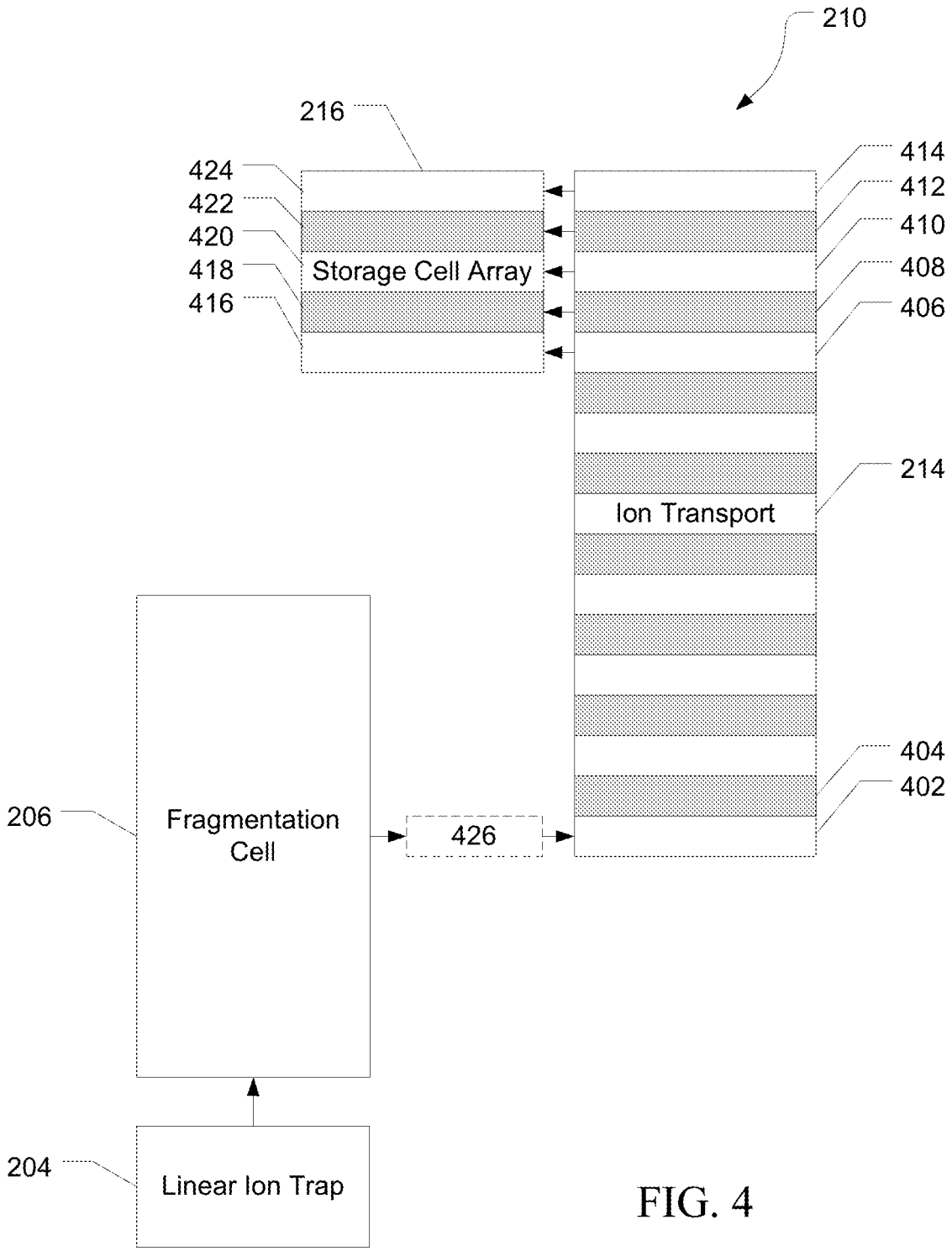
FIGS. 4 and 5 are diagrams showing detailed views of portions of the exemplary mass spectrometry system of FIG. 2, in accordance with various embodiments.

FIG. 4 illustrates the operation of timing region 210. A first narrow mass range of precursor ions are ejected from the linear ion trap 204 into fragmentation cell 206. In various embodiments, the ions can be ejected radially from the linear ion trap 204. Within fragmentation cell 206, the ions are fragmented to produce fragment ions. The fragment ions are then ejected from the fragmentation cell 206 into the first cell of the ion transport mechanism 214. In various embodiments, the ions may be ejected into an optional ion transfer element 426. The ion transfer element 426 can guide the ion from the fragmentation cell 206 to the ion transport mechanism 214. Additionally, the ions can undergo collisional cooling within the ion transfer element 426 prior to entering ion transport mechanism 214.

Once the ions are ejected from fragmentation cell 206, a second narrow mass range of precursor ions can be ejected from the linear ion trap 204 into the fragmentation cell 206. While the second narrow mass range is being fragmented, the fragment ions from the first narrow mass range can be advanced in the ion transport mechanism to a second cell 404. When the optional ion transfer element 426 is used to cool the ions before entering ion transport mechanism 214, there can be an additional step in the cycle where the ions are cooling. This cycle of advancing fragment ion packets in the ion transport mechanism 214 while ions narrow mass range precursors are ejected from the ion trap 204 and fragmenting in the fragmentation cell 206 can continue until fragment ion packets reach the end of the ion transport mechanism. When fragment ion packets have advanced to cells 406-414, the ion packets can be transferred from cells 406-414 of ion transport mechanism 214 to cells 416-424 of storage cell array 216. In various embodiments, ions can be accumulated in storage cell array 216 by repeatedly transferring ions from cells 406-414 of ion transport mechanism 214 to cells 416-424 of storage cell array 216. Given the cycle time of a few hundred microseconds for timing region 210 relative to the a chromatographic peak width on the order of a few seconds, ions from the same narrow mass range should be fairly consistent over several accumulations in storage cell array 216. For example, given a storage cell array 216 with five storage cells and a cycle time for the fragmentation cell 206 of 250 microseconds, it can take about 1.25 milliseconds to process five narrow mass ranges. Each of the five storage cells 416-424 of the storage cell array 216 can accumulate 10 ion packets in about 12.5 milliseconds, considerably faster than the chromatographic timescale. In this way, the number of fragment ions to be analyzed can be increased.

Figure 5:
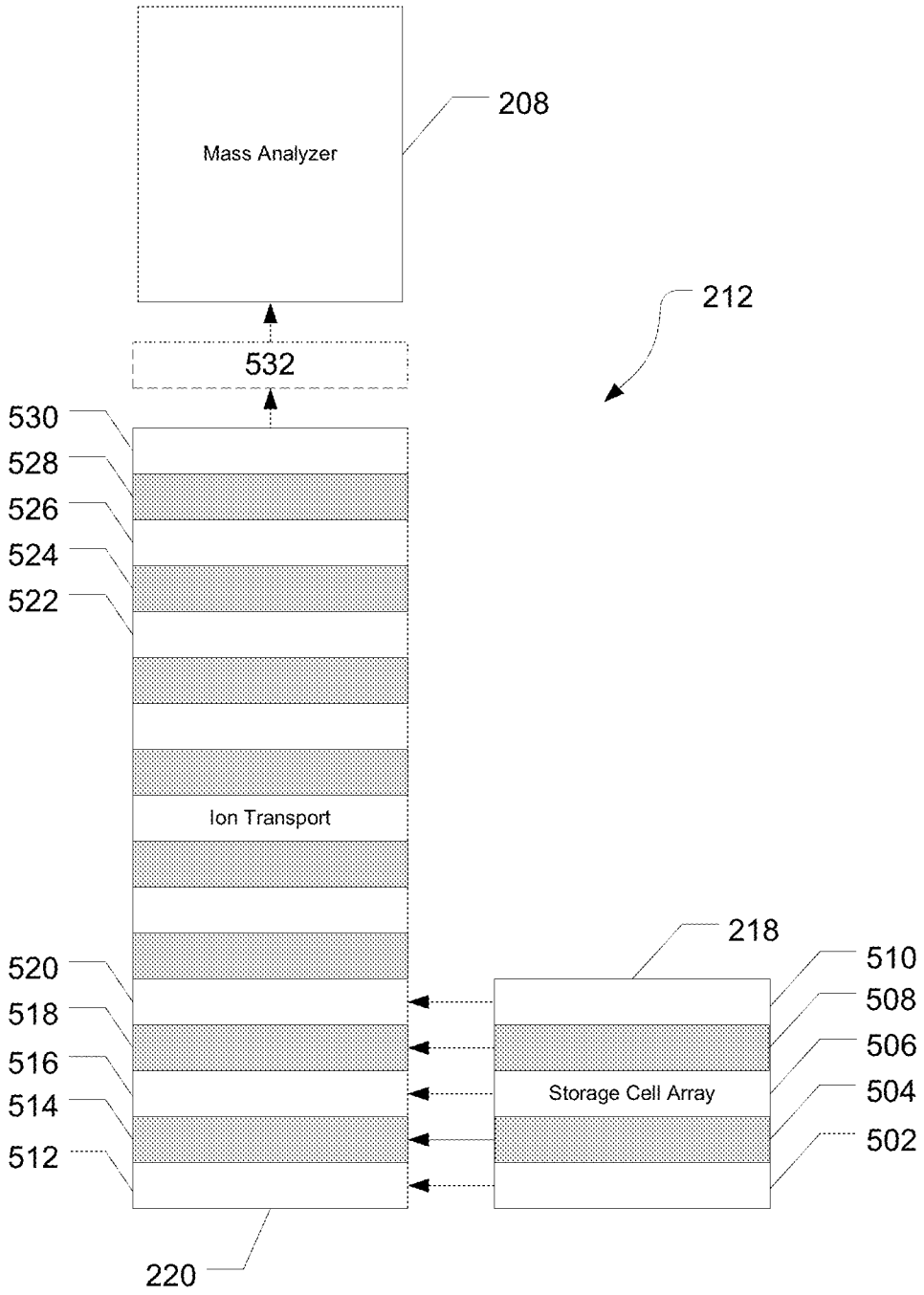

FIG. 5 illustrates the operation of timing region 212. Ion packets can be transferred from storage cell array 216 into the storage cells 502-510 of storage cell array 218. In various embodiments, ion packets from multiple cells of storage cell array 216 can be transferred into storage cell array 218 at substantially the same time. In alternate embodiments, the ion packets can be transferred into storage cell array 218 sequentially. The ion packets can be transferred substantially simultaneously from storage cells 502-510 of storage cell array to cells 512-520 of ion transport mechanism 220. Alternatively, the ion packets can be transferred sequentially provided all the ion packets are transferred before the ion transport mechanism 220 advances to avoid overlapping or creating gaps.

Once in ion transport mechanism 220, the ion packets can be advanced. After several advancements, cells 512-520 of ion transport mechanism 220 will be empty and aligned with cells 502-510 of storage cell array 218 and another set of ion packets can be transferred to the ion transport mechanism 220. When the ion packets have advanced to the end of ion transport mechanism 220 (cells 522-530), ion packets can be sequentially transferred to mass analyzer 208 for analysis. In various embodiments, the ions may be ejected from final cell 530 of ion transport mechanism 220 into an optional ion transfer element 532. The ion transfer element 532 can cool the ions prior to transferring them into the mass analyzer 208 through collisional cooling.

Since the ion packets are transferred sequentially from the ion transport mechanism 220 to the mass analyzer 208, the advancement time of the ion transport mechanism 220 needs to be synchronized with mass analyzer 208. In contract, the advancement time of ion transport mechanism 214 needs to be synchronized with fragmentation cell 206. In various embodiments, it can be desirable to transfer ion packets from storage cell array 216 to storage cell array 218 once prior to transferring ions to ion transport mechanism 220, storage cell array 216 can accumulate several ion packets during the time it takes for storage cell array 220 to transfer the ion packets to ion transport mechanism 214 and for ion transport mechanism 214 to advance the ion packets. Alternatively, multiple ion transfers can occur between storage cell array 216 and storage cell array 218 and storage cell array 218 can accumulate ions until ion transport mechanism 220 is ready to receive them.

Figure 6:
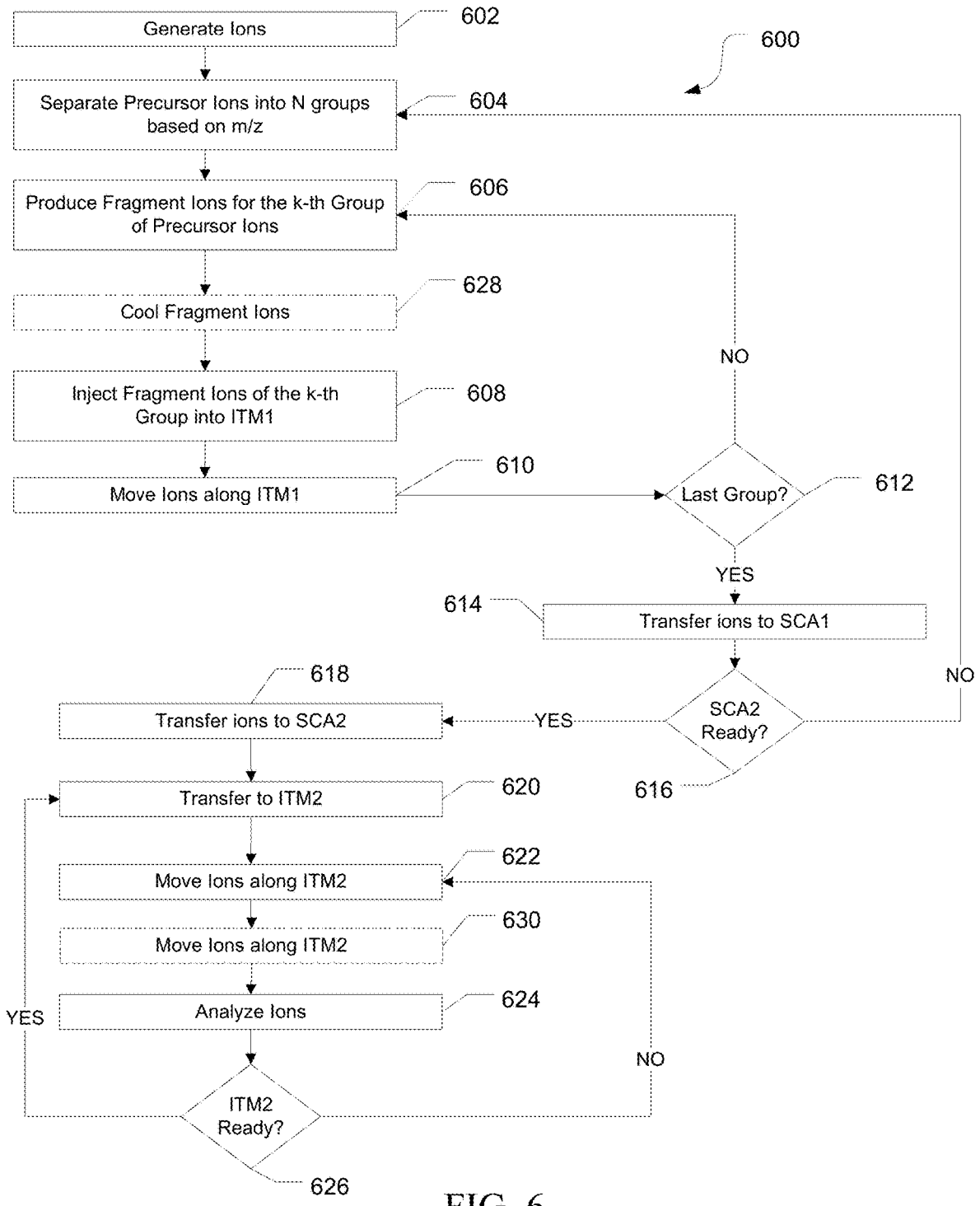
FIG. 6 is a flow diagram illustrating a method of analyzing the mass of ions in a mass analyzer, in accordance with various embodiments.

FIG. 6 is a flow diagram illustrating a process for analyzing ions, in accordance with various embodiments. At 602, the ions can be generated. Depending on the sample, the ion may be generated in a variety of ways, including but not limited to, electrospray ionization (ESI), matrix assisted laser desorption/ionization (MALDI), inductively coupled plasma ionization, or various other ionization techniques. In various embodiments, the ions can be trapped and cooled, such as in an ion trap. At 604, precursor ions can be separated based on a mass-to-charge (m/z) ratio, such as by using a linear ion trap or the like. In various embodiments, the ions may be grouped into N groups based on their m/z ratio. The groups may correspond to narrow mass ranges, such as ranges of less than about 20 Da, such as less than about 10 Da, even less than about 5 Da. At 606, the precursor ions can be fragmented to produce fragment ions. In various embodiments, precursor ions of a particular group having a particular m/z ratio or a range of m/z ratios can be fragmented together.

At 608, precursor ion or fragment ions can be injected into a first cell of a first ion transport mechanism (ITM1). In various embodiments, the ions can be injected perpendicular to the pole rods and parallel to the direction of movement of the ions within the ITM1. In alternate embodiments, the ions can be injected parallel to the pole rods and perpendicular to the direction of movement of the ions within the ITM1. At 610, the fragment ions can be moved along ITM1. For example, the voltages can go through a complete cycle, moving the fragment ions from a first cell to a second cell of the ITM1.

In various embodiments, precursor ions can be scanned out of a linear ion trap and small ranges of ions can be fragmented. The fragment ions from each range can be injected as a separate batch into ITM1. ITM1 can keep each batch of fragment ions together while keeping them separated from other batches of fragment ions generated from precursor ions having a different range of m/z ratios.

At 612, a determination can be made if the last group of ions have been injected into ITM1. If there are additional precursor ions, they can optionally be fragmented, as illustrated at 606. The cycle can continue for until each group of precursor ions is fragmented and/or injected into ITM1, that is, the cycle can repeat for each group k from 1 to N.

At 614, the ions can be transferred to a first storage cell array (SCA1). In various embodiments, the fragments ions from each group k can be transferred at the same time. Significantly, SCA1 can maintain separation between the groups similar to ITM1. Each of the cells of SCA1 can be aligned with a cell of ITM1. In alternate embodiments, the transfer can be sequential with one group being transferred from a cell in ITM1 to a cell in SCA1. In yet other embodiments, a subset of two or more groups can be transferred together followed by the transfer of another subset of groups.

At 616, a determination can be made if a second storage cell array (SCA2) is ready to receive ions. In various embodiments, SCA2 can be ready to receive ions if the storage cells of SCA2 are empty, such as after transferring their contents to a second ion transport mechanism (ITM2). If SCA2 is not ready to receive ions, additional precursors ions can be separated into groups, as illustrated at 604. In various embodiments, the precursor ions can be separated into the same narrow mass ranges as before so that when the ions are fragmented and transferred to SCA1, an individual storage cell can accumulate multiple packets of substantially the same ions.

Multiple accumulation cycles can result in larger quantities of the fragment ions than would otherwise be possible based on the capacity limits on the linear ion trap used to separate the precursor ions. For example, the linear ion trap receives a full range of ions from the ion source. However, the linear ion trap has a finite capacity, such as due to space charge limitations. Each narrow mass range of precursor ions can include a considerably smaller number of ions that the full mass range. Additionally, losses can occur during transmission and fragmentation of the ions. Multiple rounds of accumulation can compensate for ion loss from fragmentation and transmission as well as for capacity limitations of the linear ion trap.

If SCA2 is ready to receive ions, the ions can be transferred to SCA2 at 618. In various embodiments, the fragment ions stored in the various cells of SCA1 can be transferred to SCA2 substantially at the same time. Alternatively, the cells can be transferred sequentially or in subsets.

At 620, the ions can be transferred from SCA2 to ITM2. In various embodiments, the fragment ions stored in the various cells of SCA1 can be transferred to SCA2 substantially at the same time. Alternatively, the cells can be transferred sequentially or in subsets. At 622, the fragment ions can be moved along ITM2. For example, the voltages can go through a complete cycle, moving the fragment ions from a first cell to a second cell of the ITM2.

At 624, the fragment ions can be transferred a mass analyzer for mass analysis. At 626, a determination can be made if ITM2 is ready to receive additional ions from SCA2. When ions have been advanced sufficiently that the cells of ITM2 aligned with the storage cells of SCA2 are empty, ITM2 can be ready to receive addition ions, and the ions can be transferred from SCA2 or ITM2, as indicated at 620. Alternatively, at 622, the fragment ions can be advanced along ITM2 with another packet of ions being transferred to the mass analyzer for analysis.

In various embodiments, it may be advantageous to cool the ions, such as by collisional cooling after fragmentation and prior to injection into ITM1, as indicated by optional step 628, and prior to mass analysis as indicated by optional step 630. Cooling can reduce the kinetic energy of the ions which can be beneficial for containing the ions during transport in ITM1 and for mass analysis. Adding an additional component, such as ion transfer elements 426 and 532 for cooling the ions can allow cooling of the ions for an additional cycle step.

In various embodiments, a first narrow mass range can include one or more low abundance precursor ions while a second narrow mass range can include a higher abundance precursor ion. Using different numbers of accumulations can compensate for the initial differences in ion abundance. For example, the high abundance ion of the second narrow mass range can substantially fill the corresponding cell of SCA1 in one or two cycles while the low abundance ions of the first narrow mass range may take more cycles to reach the capacity of the corresponding cell of SCA1. The system can reduce the number of accumulations for the second narrow mass range to avoid fragment ion loss due to the corresponding cell being overcapacity while increasing the number of accumulations for the first narrow mass range. In various embodiments, the linear ion trap can be filled a first time and both the first narrow mass range and the second narrow mass range can be scanned out and fragmented. Then the linear ion trap can be filled a subsequent time and the first narrow mass range can be scanned out without scanning the second narrow mass range. This can reduce the number of groups of precursor ions to be processed in subsequent cycles of the linear ion trap and given sufficient numbers of skipped groups and cycles of the linear ion trap, additional cycles of the linear ion trap to increase the accumulation of fragments of the first narrow mass range can be performed in the time between transfers to SCA2.

In various embodiments, the fragment ions can be ejected from the moving latch ion transport mechanism in a direction parallel to the pole rods and perpendicular to the direction of movement of the ions within the ion transport mechanism. The fragment ions can be ejected directly into a mass analyzer, or be ejected into an ion guide or ion transport mechanism before advancing to the mass analyzer.

In various embodiments, after completing the ion transport and before ejection, continuously varying voltage pattern can be switched to static DC voltage pattern fixing momentary locations of ion pluralities in individual ion transport cells. In embodiments, ejection of ion pluralities from multiple ion transport cells can be arranged in parallel into corresponding storage cells on a cell-to-cell basis. Alternatively, ejection of ion pluralities can be arranged into a single storage cell in a consecutive way with or without switching of a repeating voltage pattern to the static DC voltage pattern.

Figure 7:
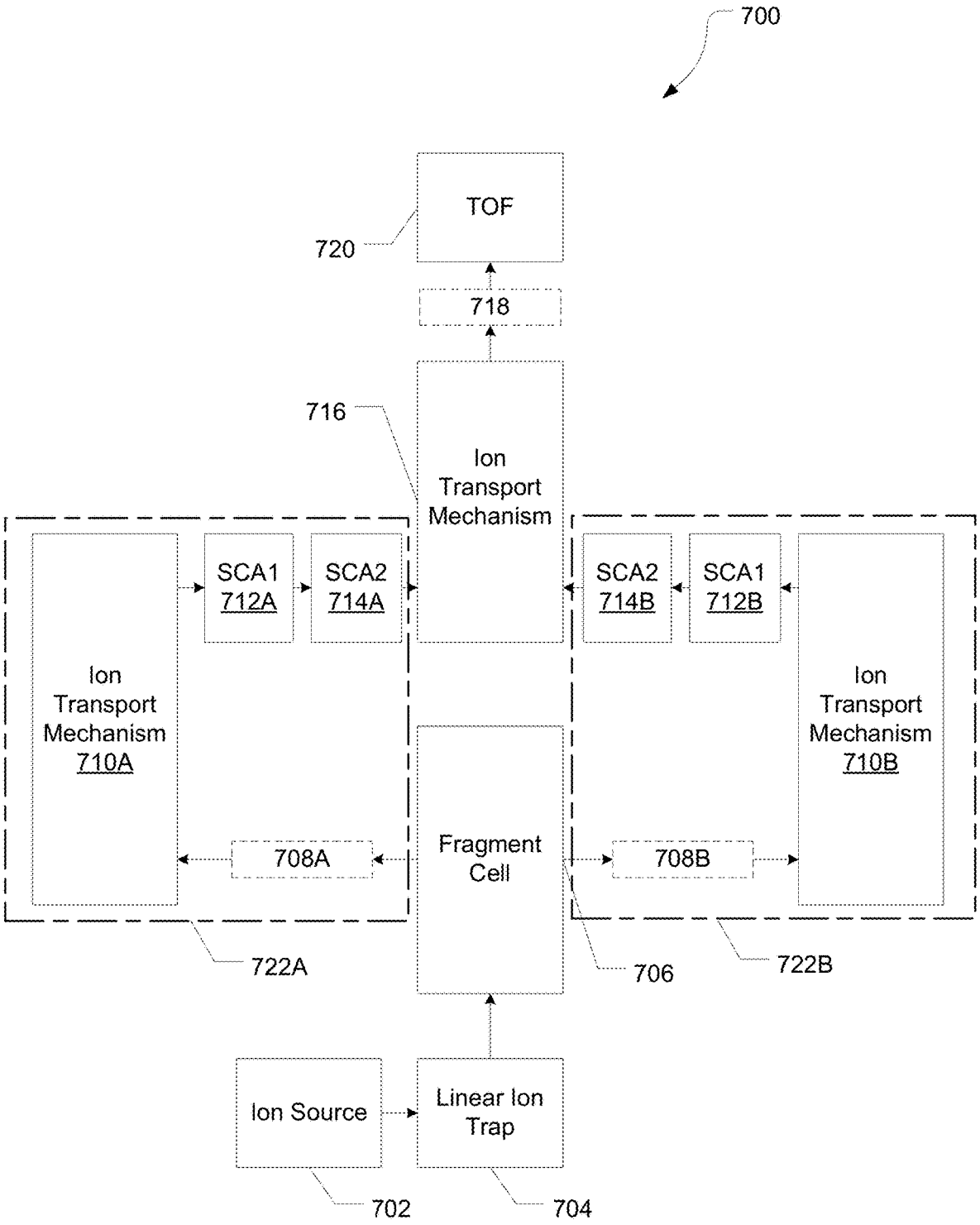
FIG. 7 is a block diagram illustrating an exemplary mass spectrometry system with dual ion paths, in accordance with various embodiments.

FIG. 7 shows a mass spectrometer 700 with dual ion paths. Mass spectrometry system 700 can include an ion source 702, a linear ion trap 704, and a fragmentation cell 706.

Ions from the ion source 702 can be accumulated in the linear ion trap 704. In particular embodiments, the linear ion trap 704 can separate the ions into a plurality of narrow mass ranges. The ions from each narrow mass range can be sent to the fragmentation cell 706 where they can be fragmented into fragment ions.

The fragmentation cell can direct ions to one of two substantially identical ion paths 722A and 722B. Ion path 722A can include an optional ion transfer element 708A for optionally cooling the ions, an ion transport mechanism 710A, a storage cell array 712A and a storage cell array 714A. Ion path 722B can include an optional ion transfer element 708B for optionally cooling the ions, an ion transport mechanism 710B, B storage cell array 712B and B storage cell array 714B. Storage cell arrays 714A and 714B can both transfer ions into ion transport mechanism 716. Ion transport mechanism can feed ions into a mass analyzer 720, or the ions can first pass through an optional ion transfer element 718 for cooling prior to the mass analyzer 720.

In particular embodiments, fragment ions from a first narrow mass range can be directed towards ion path 722A and fragment ions from a second narrow mass range can be directed towards ion path 722B. When the fragment ions have reached the storage cell arrays 714A and 714B, the fragment ions can be transferred to ion transport mechanism 716 in alternating batches. For example, storage cell array 714A can transfer fragment ions from multiple narrow mass ranges, ion transport mechanism 716 can advance until the starting cells are empty into ion transport mechanism 716, then storage cell array 714B can transfer fragment ions from multiple narrow mass ranges into ion transport mechanism 716.

Advantageously, the use of two ion paths allows for increased cooling time in the ion transfer elements 708A and 708B, as well as increasing the time available for each step along ion transport mechanisms 710A and 710B relative to the scan time for scanning a narrow mass range from the linear ion trap 704. Increasing the cooling time and the transport time can reduce the kinetic energy ion the ions.

Computer-Implemented System

Figure 8:
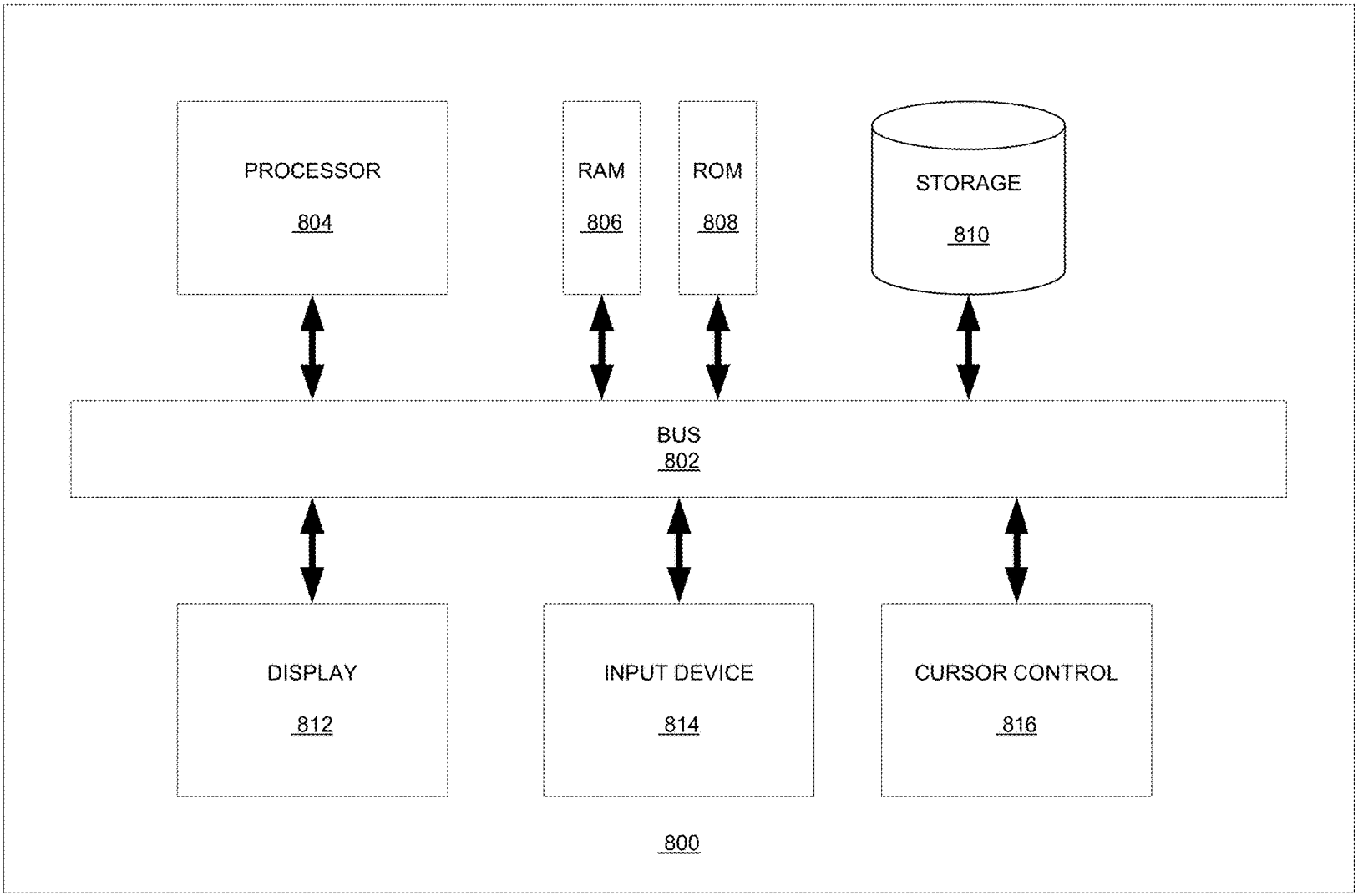
FIG. 8 is a block diagram illustrating an exemplary computer system, in accordance with various embodiments.

FIG. 8 is a block diagram that illustrates a computer system 800, upon which embodiments of the present teachings may be implemented as which may form all or part of controller 108 of mass spectrometry platform 100 depicted in FIG. 1. In various embodiments, computer system 800 can include a bus 802 or other communication mechanism for communicating information, and a processor 804 coupled with bus 802 for processing information. In various embodiments, computer system 800 can also include a memory 806, which can be a random access memory (RAM) or other dynamic storage device, coupled to bus 802 for determining base calls, and instructions to be executed by processor 804. Memory 806 also can be used for storing temporary variables or other intermediate information during execution of instructions to be executed by processor 804. In various embodiments, computer system 800 can further include a read only memory (ROM) 808 or other static storage device coupled to bus 802 for storing static information and instructions for processor 804. A storage device 810, such as a magnetic disk or optical disk, can be provided and coupled to bus 802 for storing information and instructions.

In various embodiments, computer system 800 can be coupled via bus 802 to a display 812, such as a cathode ray tube (CRT) or liquid crystal display (LCD), for displaying information to a computer user. An input device 814, including alphanumeric and other keys, can be coupled to bus 802 for communicating information and command selections to processor 804. Another type of user input device is a cursor control 816, such as a mouse, a trackball or cursor direction keys for communicating direction information and command selections to processor 804 and for controlling cursor movement on display 812. This input device typically has two degrees of freedom in two axes, a first axis (i.e., x) and a second axis (i.e., y), that allows the device to specify positions in a plane.

A computer system 800 can perform the present teachings. Consistent with certain implementations of the present teachings, results can be provided by computer system 800 in response to processor 804 executing one or more sequences of one or more instructions contained in memory 806. Such instructions can be read into memory 806 from another computer-readable medium, such as storage device 810. Execution of the sequences of instructions contained in memory 806 can cause processor 804 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 804 for execution. Such a medium can take many forms, including but not limited to, non-volatile media, volatile media, and transmission media. Examples of non-volatile media can include, but are not limited to, optical or magnetic disks, such as storage device 810. Examples of volatile media can include, but are not limited to, dynamic memory, such as memory 806. Examples of transmission media can include, but are not limited to, coaxial cables, copper wire, and fiber optics, including the wires that comprise bus 802.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, G, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A method of analyzing a sample, the method comprising:

separating precursor ions from the sample into narrow mass range groups based on mass-to-charge ratio;

fragmenting the ions from each group to create groups of fragment ions;

accumulating the fragment ions in a storage cell array from multiple fragmentations of each of the narrow mass range groups such that a first storage cell of the storage cell array accumulates fragment ions from multiple rounds of separating and fragmenting ions of a first narrow mass range and a second storage cell of the storage cell array accumulates fragment ions from multiple rounds of separating and fragmenting ions of a second narrow mass range;

mass analyzing fragment ions from each group of fragment ions using a long transient time mass analyzer;

wherein the separation and fragmentation are decoupled from the mass analyzing and the cycle time of the high transient mass analyzer is greater than about five times longer than the cycle time of a narrow mass range scan time, and wherein the separation and fragmentation has a high duty cycle and the mass analyzing has a high duty cycle.

2. The method of claim 1, wherein the cycle time of the mass analyzer is greater than about ten times longer than the cycle time of the narrow mass range scan time.

3. The method of claim 1, the cycle time of the mass analyzer is less than about 15 times longer than the cycle time of the narrow mass range scan time.

4. The method of claim 1, the cycle time of the narrow mass range scan time is between about 50 microseconds and about 500 microseconds.

5. The method of claim 1, the cycle time of the narrow mass range scan time is between about 100 microseconds and about 400 microseconds.

6. The method of claim 1, the cycle time of the narrow mass range scan time is between about 200 microseconds and about 300 microseconds.

7. The method of claim 1, the cycle time of the mass analyzer is between about 1 millisecond and about 10 milliseconds.

8. The method of claim 1, the cycle time of the mass analyzer is between about 3 milliseconds and about 7 milliseconds.

9. The method of claim 1, the cycle time of the mass analyzer is between about 4 and 6 milliseconds.

* * * * *